US010329069B2

(12) United States Patent
Ishihara

(10) Patent No.: US 10,329,069 B2
(45) **Date of Patent: *Jun. 25, 2019**

(54) SHEET-MASK PACKAGE

(71) Applicant: TAIKI CORP., LTD., Osaka-shi, Osaka (JP)

(72) Inventor: Toshio Ishihara, Osaka (JP)

(73) Assignee: TAIKI CORP., LTD., Osaka (JP)

( * ) Notice: Subject to any disclaimer, the term of this patent is extended or adjusted under 35 U.S.C. 154(b) by 179 days.

This patent is subject to a terminal disclaimer.

(21) Appl. No.: 15/503,344

(22) PCT Filed: Jul. 23, 2015

(86) PCT No.: PCT/JP2015/070904

§ 371 (c)(1),
(2) Date: Feb. 10, 2017

(87) PCT Pub. No.: WO2016/024467

PCT Pub. Date: Feb. 18, 2016

(65) Prior Publication Data

US 2018/0105343 A1 Apr. 19, 2018

(30) Foreign Application Priority Data

Aug. 13, 2014 (JP) ..... 2014-165018

(51) Int. Cl.
*B65D 85/62* (2006.01)
*B65D 81/22* (2006.01)
(Continued)

(52) U.S. Cl.
CPC ..... *B65D 81/22* (2013.01); *B65D 43/16* (2013.01); *B65D 77/02* (2013.01); *B65D 77/04* (2013.01); *B65D 83/08* (2013.01); *B65D 83/0805* (2013.01)

(58) Field of Classification Search
CPC ..... B65D 83/08; B65D 83/0805; B65D 83/0847; B65D 83/0888; B65D 85/16
(Continued)

(56) References Cited

U.S. PATENT DOCUMENTS 3,784,055 A 1/1974 Anderson
3,918,608 A 11/1975 Faller
(Continued)

FOREIGN PATENT DOCUMENTS

CN 101941556 A 1/2011
CN 102119109 A 7/2011
(Continued)

OTHER PUBLICATIONS

International Search Report (ISR) dated Aug. 25, 2015, issued for International application No. PCT/JP2015/070904.
(Continued)

*Primary Examiner* — King M Chu
(74) *Attorney, Agent, or Firm* — Law Office of Katsuhiro Arai

(57) ABSTRACT

A sheet-mask package, in order for a sheet mask to be removed from a bag to be used in a unfolded state, allows the unfolding operation of the folded sheet mask, thereby enabling the removed sheet mask to be quickly and reliably attached on the face while preventing fingers from being excessively wet. In an embodiment, the sheet-mask package 2 is obtained by storing in a package box a holed tray (T1) on which Z-folded sheet masks (1) moistened with a chemical solution are stacked and which has a hole (4) formed in the bottom of the holed tray (T1).

14 Claims, 10 Drawing Sheets

(51) Int. Cl.

| | |
|---|---|
| ***B65D 77/02*** | (2006.01) |
| ***B65D 83/08*** | (2006.01) |
| ***B65D 43/16*** | (2006.01) |
| ***B65D 77/04*** | (2006.01) |

(58) Field of Classification Search
USPC ..... 206/205, 449, 494
See application file for complete search history.

(56) References Cited

U.S. PATENT DOCUMENTS

| | | | |
|---|---|---|---|
| 5,046,640 | A | 9/1991 | Carroll |
| 7,007,801 | B2 | 3/2006 | Mangold |
| 2003/0038041 | A1 | 2/2003 | Stulens et al. |
| 2010/0228204 | A1 | 9/2010 | Beatty et al. |
| 2012/0175280 | A1 | 7/2012 | Bando et al. |
| 2015/0151885 | A1 | 6/2015 | Nakano |

FOREIGN PATENT DOCUMENTS

| | | | |
|---|---|---|---|
| JP | S63199944 | U | 12/1988 |
| JP | H1267182 | A | 10/1989 |
| JP | H04115173 | U1 | 10/1992 |
| JP | H7215379 | A | 8/1995 |
| JP | H9142550 | A | 6/1997 |
| JP | 2009078828 | A | 4/2009 |
| JP | 2010285176 | A | 12/2010 |
| TW | M258644 | U | 3/2005 |
| TW | 201038227 | A | 11/2010 |
| TW | 201400379 | A | 1/2014 |
| TW | I490148 | B | 7/2015 |
| WO | 0016678 | A2 | 3/2000 |
| WO | 2012105400 | A1 | 8/2012 |

OTHER PUBLICATIONS

Notification of Transmittal of Translation of the International Preliminary Report on Patentability (PCT/IB/338) dated Feb. 23, 2017, with International Preliminary Report on Patentability (PCT/IB/373) and Written Opinion of the International Searching Authority (PCT/ISA/237), for corresponding international application PCT/JP2015/073063.

A First Office Action issued by the State Intellectual Property Office of China dated Jul. 4, 2018 for Chinese counterpart application No. 201580043075.0. (6 pages).

An Office Action with Search Report issued by Taiwan Intellectual Property Office, dated Oct. 22, 2018, for Taiwan counterpart application No. 104125772. (10 pages).

Extended European Search Report (EESR) dated Jun. 6, 2018, issued for European counterpart patent application No. EP15831419.5 (10 pages).

[FIG. 1a]
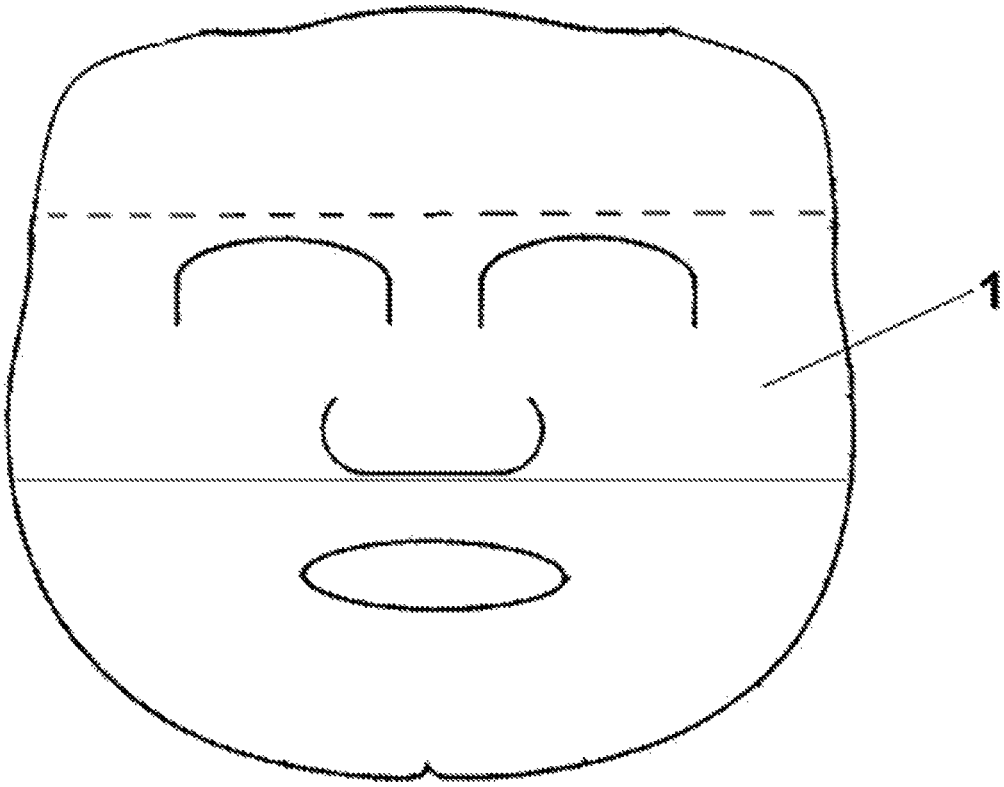

[FIG. 1b]
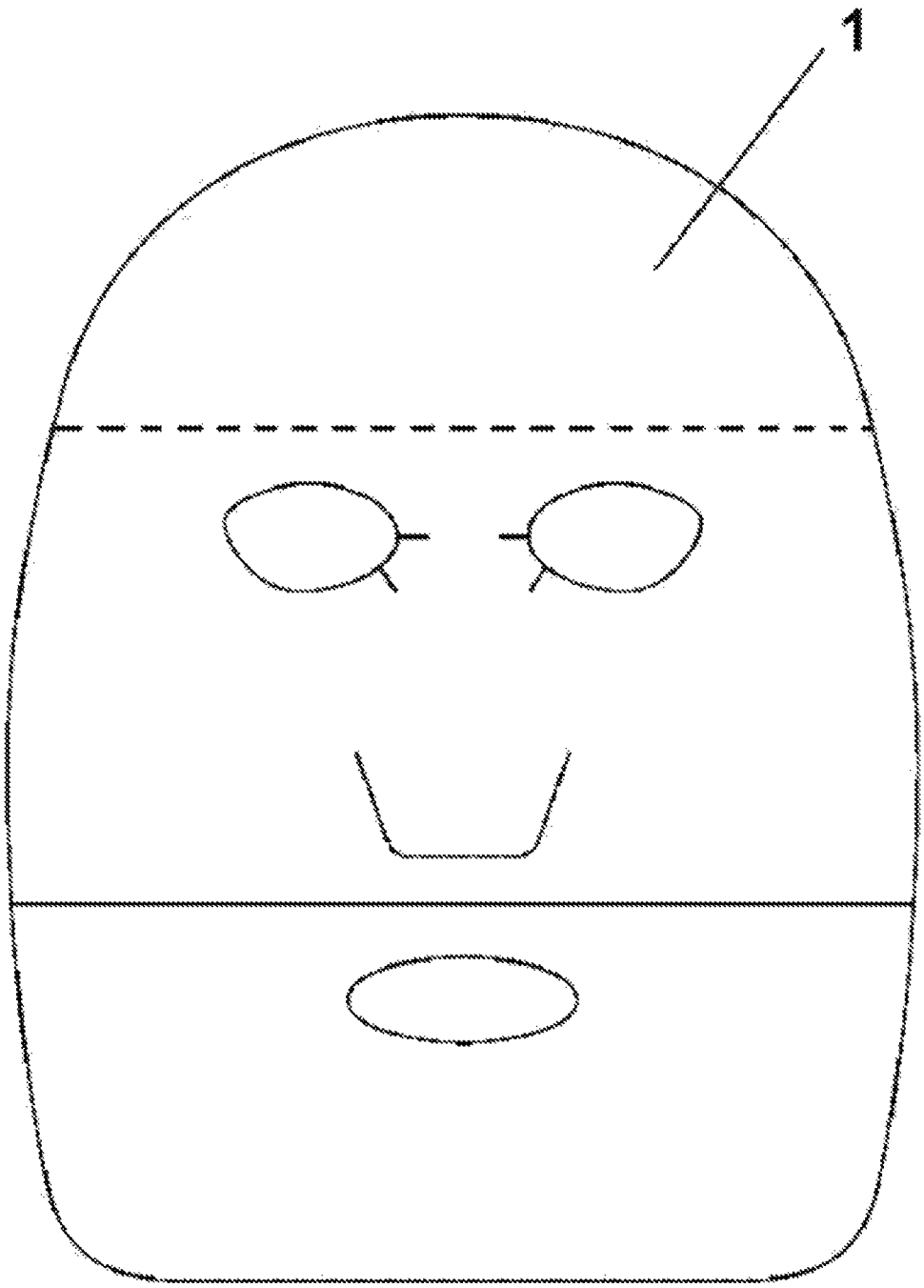

[FIG. 2]
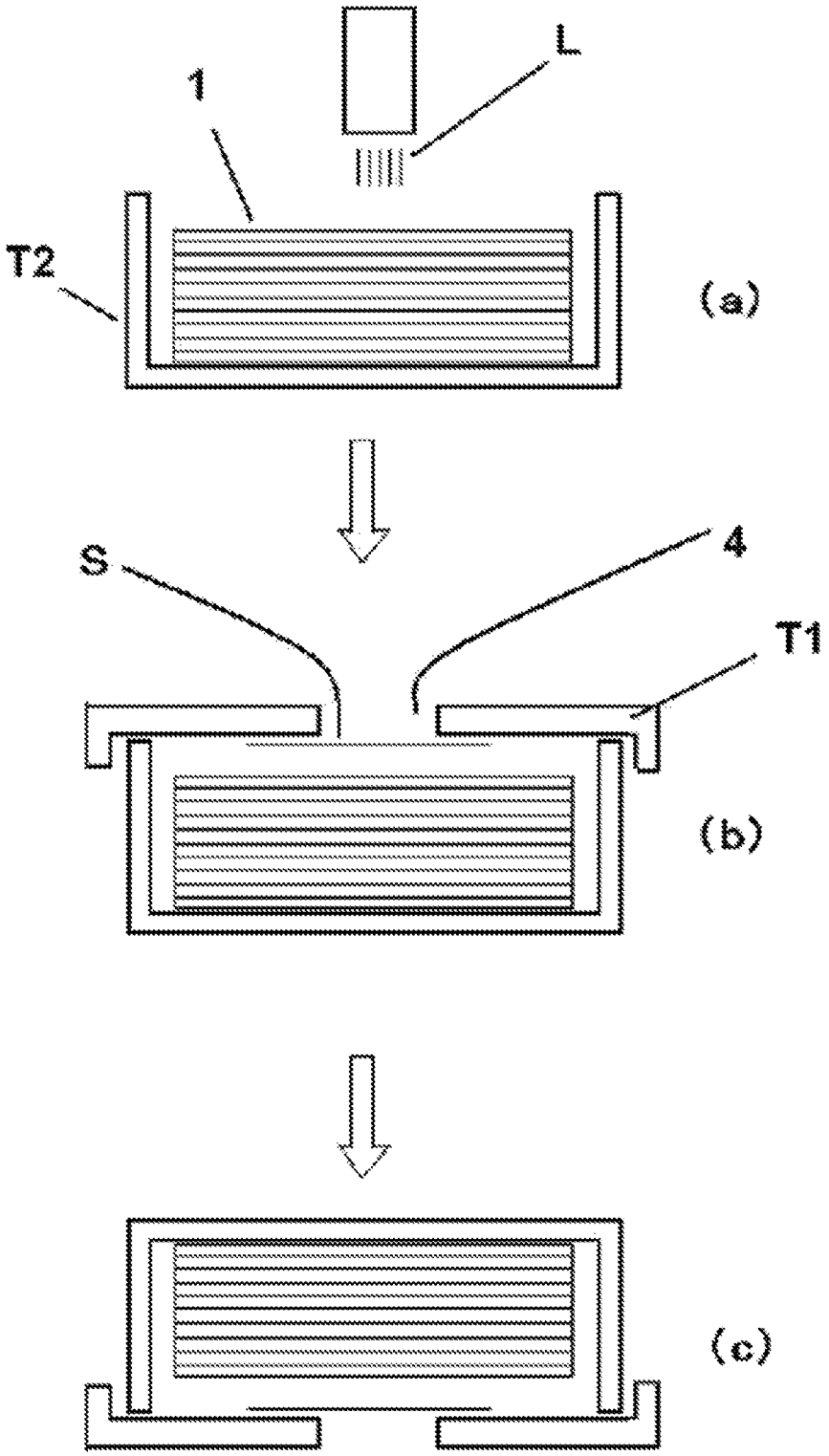

[FIG. 3]
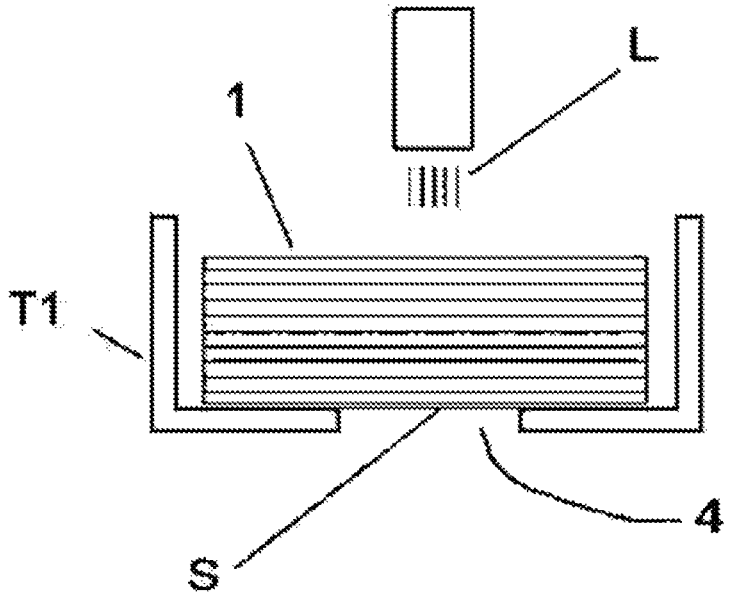
[FIG. 4]
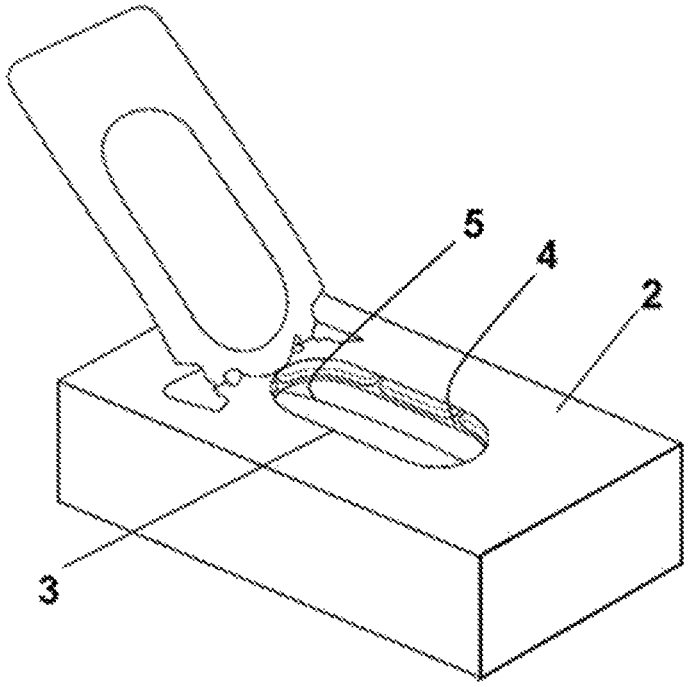

[FIG. 5]
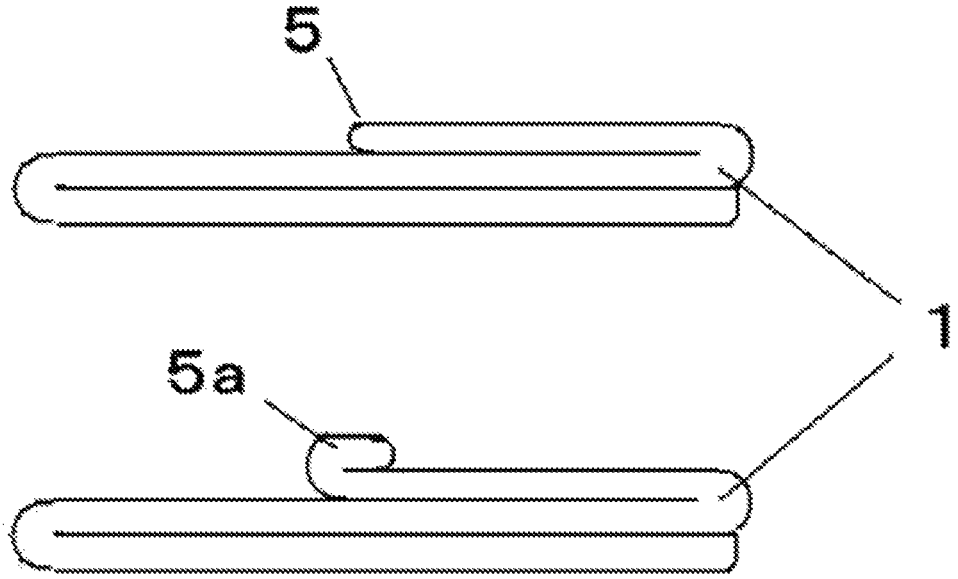
[FIG. 6]
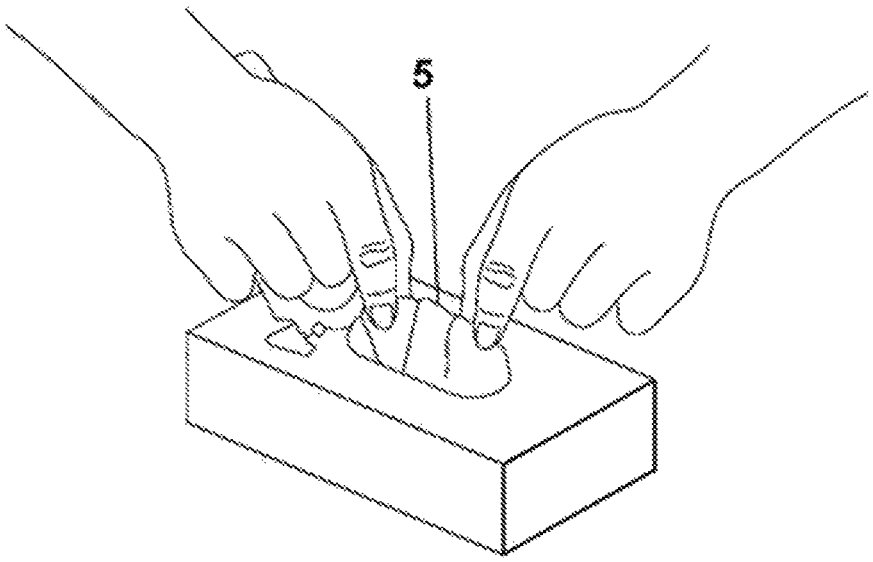

[FIG. 7]
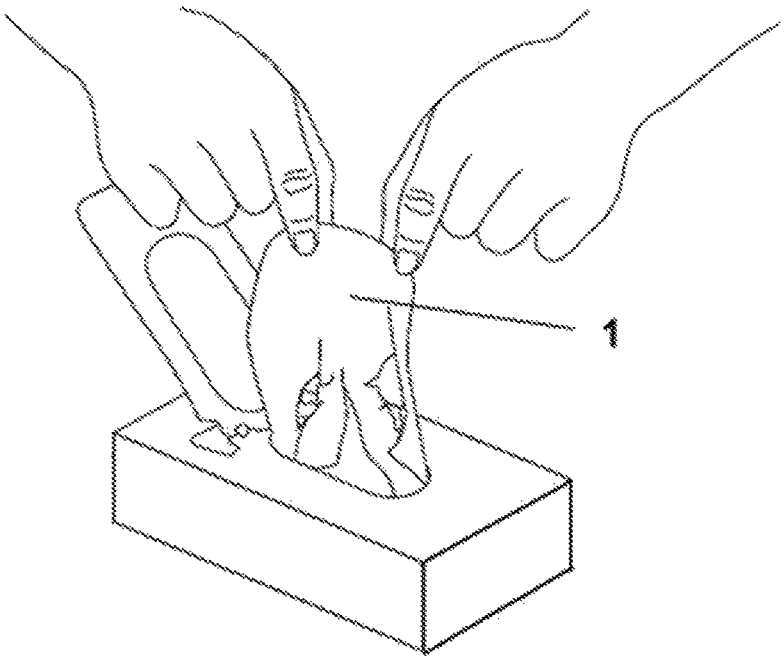
[FIG. 8]
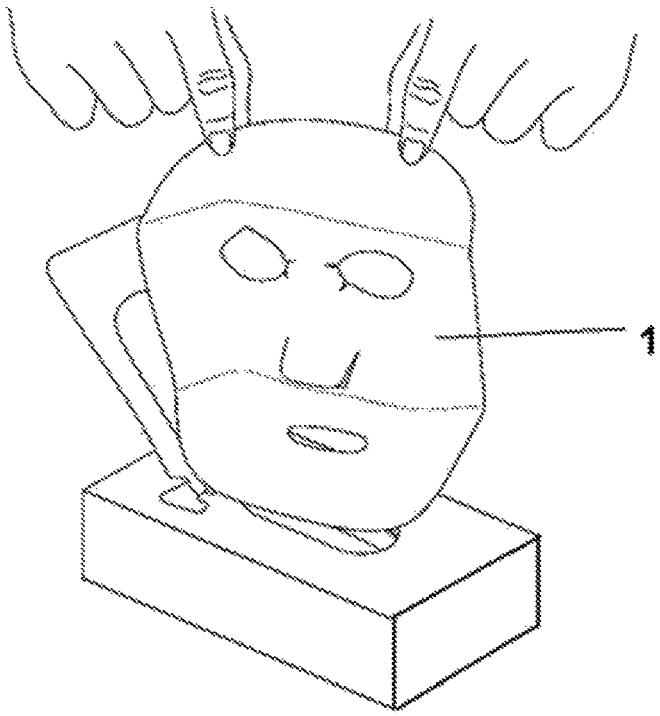

[FIG. 9]
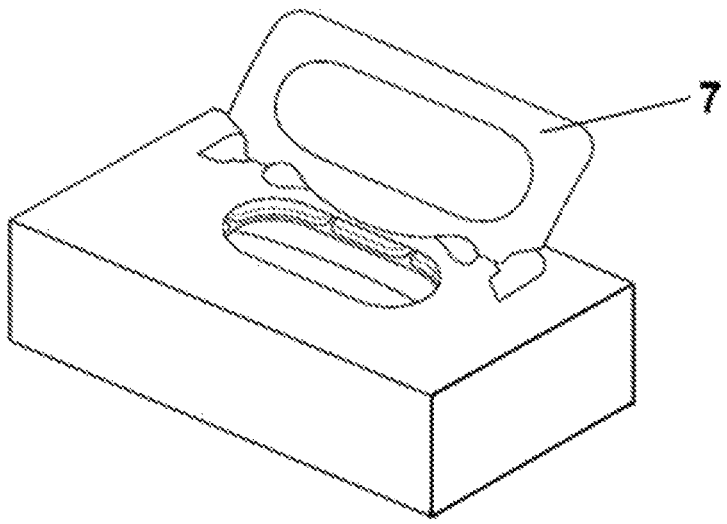
[FIG. 10]
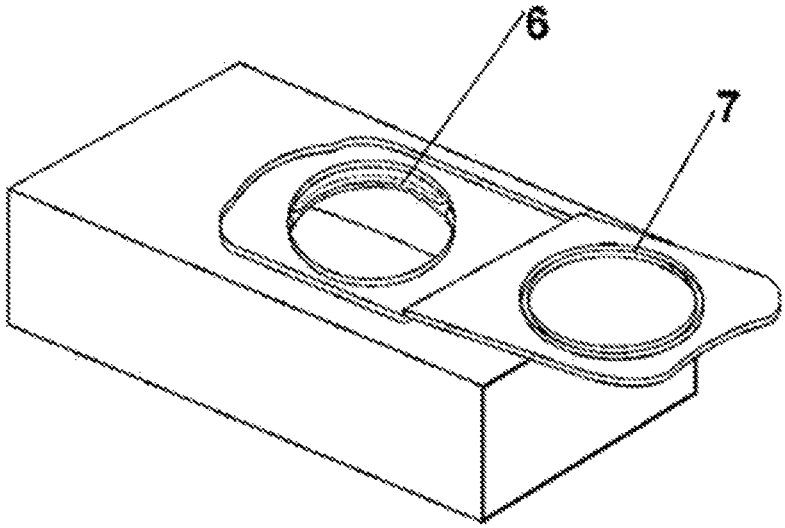

[FIG. 11]
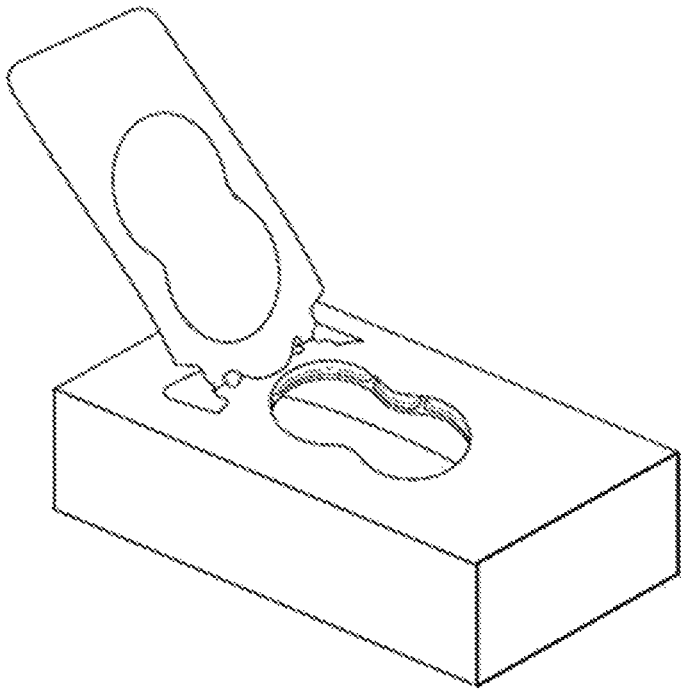
[FIG. 12]
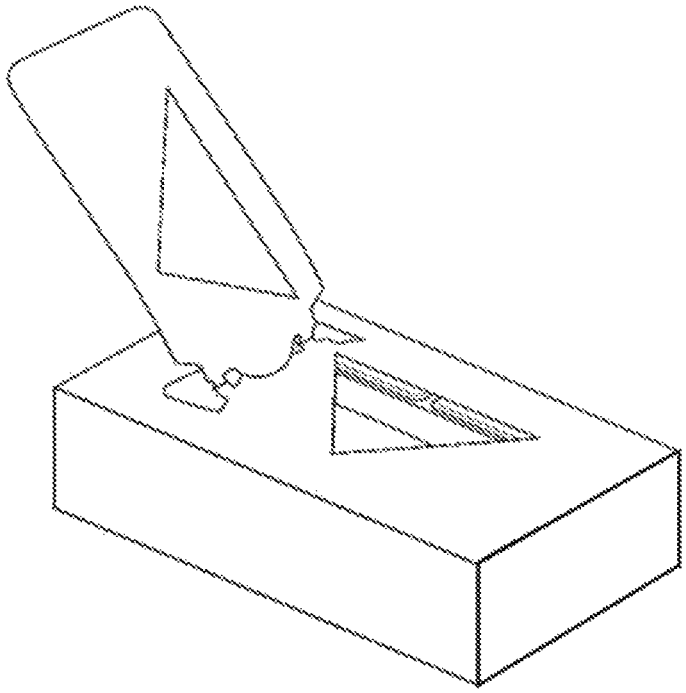

[FIG. 13]
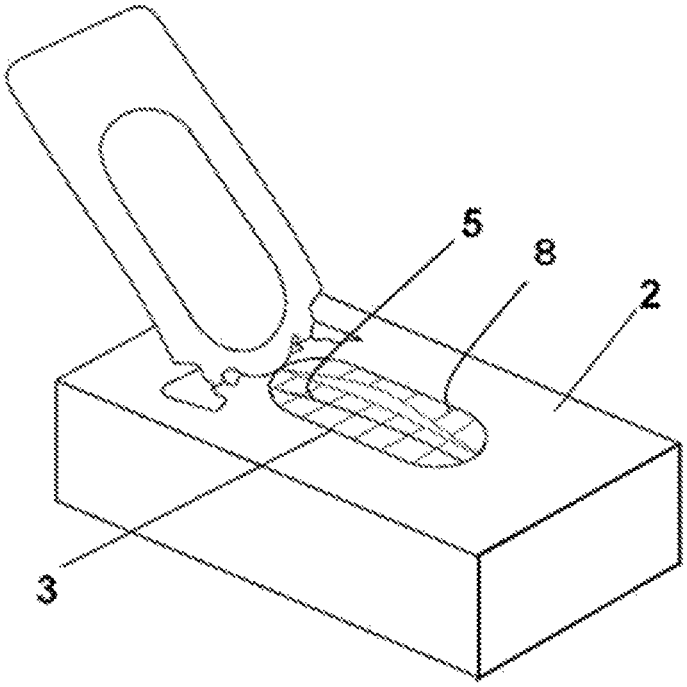

[FIG. 14]
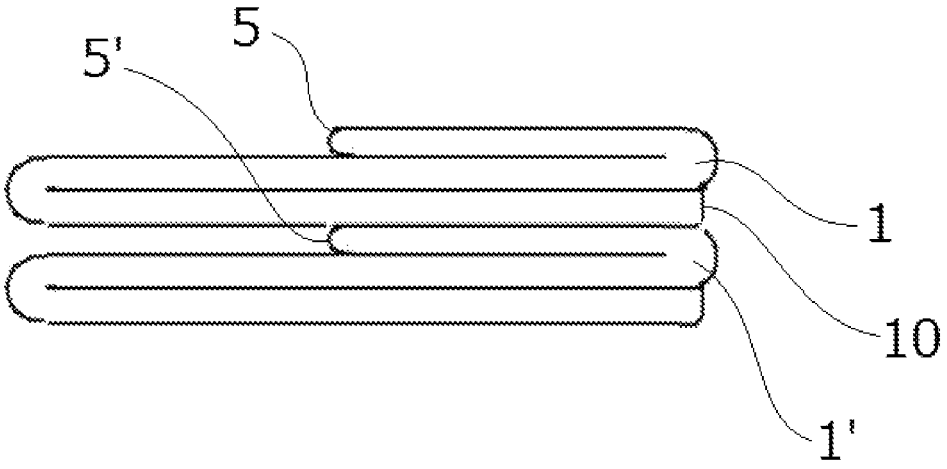

SHEET-MASK PACKAGE

This application is the U.S. National Phase under 35 U.S.C. § 371 of International Application PCT/JP2015/070904, filed Jul. 23, 2015, which claims priority to Japanese Patent Application No. 2014-165018, filed Aug. 13, 2014. The International Application was published under PCT Article 21(2) in a language other than English.

TECHNICAL FIELD

The present invention relates to a sheet-mask package containing a sheet mask impregnated with liquid cosmetic material, chemical solution, etc.

BACKGROUND ART

To package wet sheets and other sheet-shaped objects, the practice of impregnating wet sheets with a cosmetic material, chemical solution, etc., for example, and then individually packaging these wet sheets in such a way that each package can be opened to remove the wet sheet inside for use, is known. To use these wet sheets, individually packaged wet sheets are put in one bag and the individual packages are removed from the bag one by one and opened for use; however, these wet sheets, although preventing bacterial growth and attachment of contaminants because they are individually packaged, are not very user-friendly in that their packages must be opened individually to use the wet sheets.

Also, wet sheet products such as wet tissues, body wipes, or other relatively large wet sheets that are folded and stacked together to allow for pop-up, and then stored in a plastic container or packaged in a pillow-shaped package bag, are widely used. Wet sheets are also, like tissues, put in a box or bag and pulled out for use one by one from an opening at the top of the box or one side of the bag. To allow wet sheets to be removed one by one from an opening, however, they must be folded in a special way, and this complicates the manufacturing process.

Another widely used art involves individually packaging small wet sheets (such as pads for treating small areas and partial masks designed to treat specific areas of the face) and then stacking and storing them in a sealable container.

Known examples of the foregoing, or stacking small wet sheets and putting them in a box or bag, include one described in Patent Literature 1 wherein pads impregnated with a cosmetic material are stacked and stored in a container and the pads are removed one by one from an opening at the top, and another described in Patent Literature 2 using a container in which pads impregnated with a cosmetic material are stacked, wherein the pads are stacked in a manner partially overlapping each other and are removed at this overlapping part through a lidded opening at the top of the container.

Patent Literature 3 describes a flexible-material container for dispensing characterized in that it is made from a single plastic sheet which is folded into a formed product with two exterior walls and two interior walls and having a roughly W-shaped cross-section, wherein the exterior walls are partially notched at the top to create a dispensing outlet; however, this container has no sealability and no means is available, either, for sealing the notched dispensing outlet.

According to the means for stacking pads that are not individually packaged, and storing them in a container to allow them to be removed one by one from a dispensing outlet at the top, like those described in Patent Literatures 1 and 2 above, the pads that have been removed from the container must be spread with two hands for use because of the way the pads are folded.

Also, according to the art described in Patent Literature 1, the wet sheets tend to stick together, so it is not necessarily easy to separate the sheets and remove them one by one. To solve this problem, Patent Literature 2 proposes a method of offsetting the positions of adjacent sheets as they are stacked; however, this requires a larger container relative to the size of the sheet in itself, which is not desirable as it adds cost and is also counter-effective for reducing waste materials.

BACKGROUND ART LITERATURE

Patent Literature

Patent Literature 1: U.S. Pat. No. 5,046,640
Patent Literature 2: U.S. Pat. No. 7,007,801
Patent Literature 3: Japanese Utility Model Laid-open No. Sho 63-199944

SUMMARY OF THE INVENTION

Problems to be Solved by the Invention

As described above, the traditional way of individually storing wet sheets, sheet masks, and other sheets (hereinafter referred to as "sheet masks") in a bag is not sufficiently easy when it comes to removing the sheet masks from the bag, and when fingers are inserted into the bag, not only the tips of the fingers that pick up the sheet, but also other fingers and the palm, and even back of the hand, get wet from the cosmetic material, etc. As a result, one object of the present invention is to minimize such wetting, except for wetting of the tips of the fingers that pick up the sheet mask, when removing the sheet mask from the bag.

In addition, another object of the present invention is to allow the folded sheet mask that has been removed, to be spread in an easy, reliable manner for use, so that the sheet mask can be placed on the face, etc., quickly and reliably without getting the fingers wet or causing the sheet mask to break or wrinkle.

Means for Solving the Problems

The present invention achieves the aforementioned objects by adopting a specific package for storing sheet masks, and to be specific, the present invention adopts the means described below:

1. A sheet-mask package constituted by a package box and a holed tray stored in the package box, which holed tray has a hole at the bottom and on which holed tray a stack of sheet masks that have been moistened with a chemical solution and then Z-folded is placed.
2. A sheet-mask package according to 1, wherein the hole is made in such a way that a preformed hole is sealed with a liquid-impermeable sheet and the hole is opened when the liquid-impermeable sheet is removed.
3. A sheet-mask package according to 1 or 2, wherein the Z-folded sheet masks are stacked in such a way that, when the sheet-mask package is placed with the hole in the holed tray facing up, the end of the bottom face of the sheet mask at the top is positioned on the end of the top face of the sheet mask underneath.
4. A sheet-mask package according to any one of 1 to 3, wherein, when the sheet-mask package is placed with the hole in the holed tray facing up, the end of the top face of the Z-folded sheet mask is positioned at the center of the folded sheet mask.

5. A sheet-mask package according to any one of 1 to 4, wherein the package box contacting the hole provided in the holed tray has a window formed in it that can be opened for dispensing.
6. A sheet-mask package according to 5, wherein the package box contacting the hole provided in the holed tray has an outline of a window pre-formed using a thin area part so that a window can be formed in such a way that the outline of the window is torn by applying an external force along the thin area.
7. A sheet-mask package according to 5, wherein the window has a lid member that can engage with and hermetically seal the rim of the window.
8. A sheet-mask package according to any one of 1 to 7, wherein the holed tray in which the sheet masks are placed is combined with a separate tray positioned upside down.
9. A sheet-mask package constituted by a package box with a window, in which sheet masks that have been moistened with a chemical solution, Z-folded, and stacked together, are stored.
10. A sheet-mask package according to 9, wherein, in a state where the sheet-mask package is placed, the Z-folded sheet masks are stacked in such a way that the end of the bottom face of the sheet mask at the top is positioned on the end of the top face of the sheet mask underneath.
11. A sheet-mask package according to 9 or 10, wherein the end of the top face of the Z-folded sheet mask is positioned at the center of the folded sheet mask.
12. A sheet-mask package according to any one of 9 to 11, wherein the package box has an outline of a window pre-formed using a thin area part so that a window can be formed in such a way that the outline of the window is torn by applying an external force along the thin area.
13. A sheet-mask package according to 12, wherein the window has a lid member that can engage with and hermetically seal the rim of the window.

Effects of the Invention

The package in which sheet masks are stored, as proposed by the present invention, is such that the contained sheet masks that are impregnated with a cosmetic material or other chemical solution, are packaged so that their drying or degradation is prevented during storage before use, and when they are used, the sheet masks can be removed from the package with ease without the fingers and hand getting excessively wet, and furthermore the sheet masks that have been removed can be spread easily and reliably without the fingers getting excessively wet.

Also, sheet masks can be placed in a holed tray and then stored in a package box in this condition, in which case the holed tray prevents the shape of the sheet-mask-dispensing outlet in the sheet-mask package from deforming and the sheet masks can be removed easily as a result. Additionally, if the sheet-mask package is constituted by combining a holed tray in which sheet masks are placed, with the separate tray positioned upside down, then the shape of the sheet-mask package reflects the shape constituted by the two combined trays, to achieve excellent ease of handling when the package is stored, transported, etc., as well as excellent holdability of sheet masks in hands when they are used.

Furthermore, when sheet masks are stored in a package box without being placed in a holed tray, the sheet masks can be separated and removed one by one by utilizing the rigidity of the material constituting the package box.

BRIEF DESCRIPTION OF THE DRAWINGS

FIG. 1*a* Drawing of a sheet mask

FIG. 1*b* Drawing of a sheet mask

FIG. 2 Drawing showing an example of a process to place sheet masks in a separate tray and supply a chemical solution FIG. 3 Drawing showing an example of a process to place sheet masks in a holed tray and supply a chemical solution FIG. 4 Drawing of a sheet-mask package before sheet masks are removed FIG. 5 Drawing showing how sheet masks are folded FIG. 6 Drawing showing a situation when removing a sheet mask from the sheet-mask package FIG. 7 Drawing showing a situation when removing a sheet mask from the sheet-mask package FIG. 8 Drawing showing a situation when removing a sheet mask from the sheet-mask package FIG. 9 Drawing showing an embodiment of a sheet-mask package FIG. 10 Drawing showing an embodiment of a sheet-mask package FIG. 11 Drawing showing an embodiment of a sheet-mask package FIG. 12 Drawing showing an embodiment of a sheet-mask package FIG. 13 Drawing showing an embodiment of a sheet-mask package with a film provided in the window FIG. 14 Drawing showing how sheet masks illustrated in FIG. 5 are stacked

DESCRIPTION OF THE SYMBOLS

1: Sheet mask
2: Sheet-mask package
3: Window
4: Hole
5: End
6: Outline of window
7: Lid member
8: Film
T1: Holed tray
T2: Separate tray
L: Chemical solution
S: Liquid-impermeable sheet

MODE FOR CARRYING OUT THE INVENTION

The present invention is a package constituted by a package box in which folded sheet masks are stacked and placed on a holed tray having a hole at the bottom, or in which a stack of folded sheet masks is stored without the holed tray being used and on which a window is formed.

The present invention is explained based on the drawings.

FIGS. 1*a* and 1*b* show a sheet mask 1 which will be placed in a holed tray to be stored in the sheet-mask package proposed by the present invention.

The sheet mask 1 shown in FIGS. 1*a* and 1*b* is Z-folded. The desired Z-folds are formed by, for example, valley-folding the sheet along the thin line extending horizontally below the nose area (i.e., folding the sheet so that the part of the sheet where the eyes and nose are formed overlaps the part of the sheet mask below the thin line or specifically the part where the mouth is formed, in FIGS. 1*a* and 1*b*), and then mountain-folding the sheet along the broken line extending horizontally above the eye area (i.e., folding back the forehead part of the sheet mask over the reverse side of the sheet mask).

It goes without saying that the method of folding the sheet mask 1 is not limited to the folding method shown in FIGS. 1*a* and 1*b* and any other folding method can be used so long as Z folds can be achieved, and the shape of the sheet mask 1 is not limited to the shape shown in FIGS. 1*a* and 1*b*, either. As explained later, the folding method is not limited in any way so long as the sheet mask 1 that has been removed can be spread easily.

As necessary, sheet masks 1 that have been Z-folded this way are stacked and stored in a holed tray whose hole made at the bottom is pre-sealed with a liquid-impermeable sheet, or in a holed tray with an outline of hole pre-formed using a thin area part at the bottom so that a hole can be formed by applying an external force along the thin area to tear the outline of hole.

Also, sheet masks need not have the shape illustrated in FIGS. 1*a* and 1*b*, and furthermore sheet masks used for other purposes or on parts of the face may be stored, that is, sheet masks stored in the sheet-mask package proposed by the present invention are not limited to sheet masks covering the entire face.

The material constituting the sheet mask is not limited in any way, either, although it must be flexible enough to bend and must not tear or otherwise break when pulled at folded ends.

Such sheet mask material is not limited in any way, and paper, resin sheets, metal sheets, woven or nonwoven fabric made of organic compounds or inorganic compounds, etc., can be used so long as it can constitute a bendable sheet mask.

For the base material of sheet masks to be stored in the package box under the present invention, which is basically a liquid-absorbent sheet, any fiber sheet such as knitted, woven, or nonwoven fabric, paper, or foam can be used, among others. Among foamed sheets, polyurethane foam, NBR foam, and other sponge sheets offering excellent liquid absorbency and liquid retentivity can be used; in terms of economy and skin safety, however, fiber sheets primarily made of natural fibers, such as cotton, pulp, and rayon, are preferred. For the manufacturing method, any known method can be employed that uses a weaving machine, resin molding machine, or any of various nonwoven fabric-forming methods, etc.

In addition to the above, a laminate such as a laminate sheet constituted by fiber sheet or foamed sheet and resin film can be used. Use of a sheet laminated on one side with a thin synthetic resin film, as the base material, is preferred because the water repellency of the film makes it easier to separate the sheets, even in wet state.

The shape of the sheet mask under the present invention may be a circle, oval, comma-shaped bead, polygon, or other desired shape, and the sheet mask need not be folded, although the sheet mask is folded so that when it is pinched with fingers and raised, the folded parts will naturally extend and spread.

The chemical solution impregnated in the sheet mask is a cosmetic material, etc., but it is not limited in any way and may be water, cosmetic lotion, cleansing agent, etc., where it is good that the sheet mask is impregnated with a chemical solution that does not corrode the sheet material or package box.

Under the present invention, any known, desired chemical solution can be impregnated in or attached to the sheet masks as they are stored. It can be any state, such as liquid, paste, cream or gel, where examples include skincare cosmetics such as face wash, skin lotions, skin milks, etc., makeup cosmetics such as foundation and cheek color, aromatic products, whitening agents, antioxidants, anti-wrinkle agents, moisturizers, sunscreen lotions, depilatories, antibacterial agents, disinfectants, acne treatment agents and various other desired cosmetic materials, chemical agents, and surface-active agents, among others. Cosmetic materials, chemical agents, cleansing agents, and other chemical solutions that can be used favorably under the present invention are in liquid form having varying viscosity, or in semi-liquid form such as cream or gel.

The retained amount of cosmetic material, chemical agent, or cleansing agent is preferably in a range of 30 to 800 percent by weight, and may be in a range of 30 to 500 percent by weight, relative to the weight of the base material of sheet mask. If the cosmetic material, chemical agent, or cleansing agent is liquid, use of 30 percent by weight or less does not allow the cosmetic material, etc., to be applied efficiently because the application amount is too small; if the amount used exceeds 800 percent by weight, on the other hand, the liquid retention capacity of the sheet mask is exceeded and any excess liquid applied tends to drip and collect at the bottom of the package box.

Also, the package box may be made of any material, such as metal, resin, paper, or woody material so long as it can be formed into a box shape and can store wet sheet masks in an airtight manner. Also, a layer can be provided on the interior face of the box made of such material, if necessary, where such layer is constituted by a film comprising one or more resin layers, or a laminate film having aluminum or other metal layers.

An opening is provided in the package box and stacked sheet masks are inserted through the opening, after which the opening is closed to produce a package box containing sheet masks.

A sheet-mask package according to the present invention can be obtained by placing Z-folded sheet masks in a holed tray and then putting a skin lotion or other chemical solution in the holed tray to impregnate the sheet masks, while at the same time storing the entire holed tray in a package box, and sealing the opening of the package box by any known means such as thermal fusion, bonding, or fitting.

FIG. 2(*a*) shows the stage, pertaining to a sheet-mask package according to the present invention, where sheet masks are placed in a separate tray T2 before being stored in the package box. There is no hole 4 at the bottom of the separate tray T2, and by placing multiple Z-folded sheet masks 1 in the separate tray T2 and then supplying a skin lotion or other chemical solution L into the separate tray T2 from above, the sheet masks in the separate tray T2 are impregnated. Chemical solution L can be supplied into the separate tray T2 first, before sheet masks are placed in the separate tray T2.

Next, a holed tray T1 is placed over the separate tray T2 in a manner covering its top opening, as shown in FIG. 2(*b*). A hole 4 is formed at the bottom of this holed tray T1. The holed tray T1 can be simply placed over the separate tray T2, or a means for fixing the holed tray T1 to the separate tray T2, such as bonding or welding, can be adopted.

Now, the hole 4 in the holed tray T1 is closed by a liquid-impermeable sheet S. Closing the hole 4 this way prevents leakage of the chemical solution from the tray into other areas of the package box when the sheet-mask package turns or is upside down during storage or distribution.

Then, the separate tray T2, holed tray T1, and sheet masks 1 placed therein, are flipped upside down, as shown in FIG. 2(*c*), and stored in the package box.

The obtained package box has the structure of the sheet-mask package, where the sheet masks 1 placed in the holed tray T1 are covered by the separate tray T2 positioned upside down.

Other than the method where the separate tray T2 is used for storage as shown in FIG. 2 above, certainly a method where the separate tray T2 is not used can be employed. As shown in FIG. 3, for example, a hole 4 is formed at the bottom of a holed tray T1, and the hole 4 is closed with a liquid-impermeable sheet S. Here, the liquid-impermeable sheet S is used in such a way that the hole 4 in the holed tray T1 is closed on the inside. Z-folded sheet masks 1 are placed in this holed tray T1, and then a chemical solution L is supplied into the holed tray T1 from above, to impregnate the sheet masks 1 in the holed tray T1. The chemical solution L can be supplied into the holed tray T1 first, before the sheet masks 1 are stored in the holed tray T1. Thereafter, the holed tray T1 and sheet masks 1 placed therein, are stored together in a package box.

It should be noted that the holed tray and separate tray used in FIGS. 2 and 3 must be made of resin, metal, or other material, and also structured in such a way that the tray can retain its shape and the chemical solution does not permeate through it. This way, the resulting sheet-mask package as a whole can provide sufficient strength during storage, transport and use.

The sheet-mask package under the present invention, thus obtained, is used as shown in FIG. 4 and the figures that follow, for example.

FIG. 4 shows a condition of the sheet-mask package 2 with a window 3, where the window 3 has been opened by fingers, etc., while the hole 4 provided at the bottom of the holed tray has also been opened by removing the sheet, etc., that was sealing it.

FIG. 5 is a section view of the Z-folded sheet masks 1. These Z-folded sheet masks 1 are stored in the sheet-mask package so that their ends 5 are positioned above, and as a result the end 5 of the Z-folded sheet mask constituting the top layer is positioned at the center of the Z-folded sheet mask where it is visible through the hole 4 provided at the bottom of the holed tray. FIG. 14 is a section view of the Z-folded sheet masks (when the sheet-mask package is placed with the hole in the holed tray facing up as shown in FIG. 5), wherein the Z-folded sheet masks 1, 1' are stacked in such a way that an end 10 of a bottom face of a sheet mask 1 at a top is positioned above an end 5' of a top face of a sheet mask 1' underneath.

Also, in FIG. 5, the end denoted by 5*a* is a folded end obtained by folding the aforementioned end 5 once more. The purpose of this is to clearly show where to pinch with fingers when only one of the sheet masks 1 stored in the sheet-mask package 2 is to be picked up with fingers and removed, and also to make it easy to pick up the sheet mask 1 by catching the small end-fold around the fingertips. By providing this end denoted by 5*a*, the ease of removing the sheet masks 1 can be improved further under the present invention.

It should be noted that, by coloring the respective ends 5, 5*a*, these ends can be identified in a visually clear manner.

FIG. 6 shows a condition of this sheet mask 1 where its end 5 is pinched with fingers, and clearly the hole at the bottom of the holed tray, and at least the window provided in the package box, must be large enough to allow the end of the sheet mask to be pinched with fingers. While the sheet mask is pinched with a total of four fingers on two hands in FIG. 6, the pinching method is not limited to this example and it is possible, for instance, to pinch the end 5 of the sheet mask with two fingers on one hand.

FIG. 7 shows the stage where the sheet mask 1, which is being pinched with fingers, is pulled up from the sheet-mask package. As the Z-folded sheet mask 1 is pulled up, it extends and spreads.

FIG. 8 shows the sheet mask 1 that has been pulled up from the sheet-mask package, and the sheet mask 1 becomes extended and is spread without fail when pulled up fully.

The sheet mask 1, thus pulled up, is placed over the face with one hand or two hands, just like a normal sheet mask, and because only one sheet mask is removed from the sheet-mask package and used on the face without fail, mistakes can be prevented where the user wanted to remove only one sheet from the sheet-mask package but ended up removing two or more sheets.

Also, because use of the fingers is kept to a minimum when removing the sheets, the sheet-mask package can be used comfortably.

Moreover, the Z-folded sheet mask 1 that was stored directly below the sheet mask 1 that has been removed, is now positioned so that its end faces the window in the package box and the hole provided at the bottom of the holed tray in the package box, and the sheets can be removed one after another in the same manner.

The user can remove the sheet mask 1 in this condition shown in FIG. 8 and put it over his/her face, etc., directly, without having to re-grip it.

Moreover, according to this example, the sheet mask 1 can be removed and used without having to release the fingers from or re-grip the sheet mask 1, which means that the entire process, from removing the sheet mask 1 from the sheet-mask package to using it, can be performed in an easy, reliable manner, and other fingers, etc., do not get wet, either.

In FIG. 9, the window 3 in the package box opens in a direction angled at 90 degrees from the direction in which the window 3 shown in FIGS. 4 and 10 to 12 opens. By adopting this direction, the window 3, even if it moves in the closing direction when the sheet mask is removed, can be easily held with the hand or hands removing the sheet mask.

In the examples shown in FIGS. 4 and 9, the hole provided at the bottom of the holed tray is a rectangle with rounded corners; however, it can have other shapes such as a normal rectangle or rectangle with arced, short sides. It goes without saying that the shape of the opening provided in the package box can be changed to match any such shape of the hole.

According to the mode shown in FIG. 10, the window provided in the package box is circular and the outline of the window is pre-formed using a thin area part so that the window can be formed, where the sealing piece that seals the outline of window and the window is formed along the thin area using a member that can be opened by applying an external force to tear the thin area, thereby cutting and removing the piece.

The sheet-mask package in FIG. 10 has a lid member 7 provided on it that can engage with and hermetically seal the outline 6 of the window so that the circular window can be sealed in an openable/closable manner. When the sheet-mask package under the present invention is not in use, the lid member 7 hermetically engages with the outline 6 of the window to prevent the skin lotion or other chemical solution permeated in the sheet masks from evaporating and thus making it difficult to use them next time.

As a result, the sheet masks are kept hermetically when not in use.

Then, when the sheet masks under the present invention are again used, the lid member 7 is opened and the sheet masks can be removed using fingers as shown in FIGS. 6 to 8.

Such lid member 7 is formed separately from the package box, and integrally attached to the attachment part of the package box by fusion, bonding, or any other known means.

In the example shown in FIG. 11, the hole provided at the bottom of the holed tray has a bottle gourd shape. In this case, a pressure force can be applied, as the sheet mask is removed, to the constricted part in a direction perpendicular to the direction of pulling up the sheet mask, which allows the Z-folded sheet mask to extend in a more reliable manner.

In the example shown in FIG. 12, the hole provided at the bottom of the holed tray has a triangle shape. In this case, when the sheet mask is removed, the sheet mask is pulled up while keeping it in contact with the sides of the triangle, and because a pressure force is applied to a direction perpendicular to this pull-up direction, the Z-folded sheet mask can be extended in a more reliable manner, just like in the example shown in FIG. 11.

The foregoing explained the present invention when a holed tray is adopted, but if a holed tray is not adopted under the present invention, the following method can be adopted: Z-folded sheet masks are stacked in a different container or tray first, and a chemical solution is supplied to impregnate them. The obtained stack of impregnated Z-folded sheet packs is inserted, together with the container or tray, into a separately prepared package box through its opening and the container or tray is removed and collected, after which the package box is sealed.

Another method can be adopted, where Z-folded and stacked sheet masks are inserted into a package box through its opening, and then a chemical solution is supplied into the package box to impregnate the sheet masks inside, after which the package box is sealed.

FIG. 13 shows an example of the present invention where no tray is used. In this example, a flexible film 8 can be provided in the window 3 as necessary. The film 8 has a slit, and when removing a sheet mask in the package through this slit, the sheet mask being pinched with fingers rubs against the film and thus separates from the next sheet mask below, to allow only one sheet mask to be removed.

It goes without saying that, even when no film 8 is provided, the sheet mask being pinched with fingers still rubs against the window 3 and thus separates from the next sheet mask below, to allow only one sheet mask to be removed.

What is claimed is:

1. A sheet-mask package constituted by a package box and a holed tray stored in the package box, which the holed tray has a hole at a bottom and on which holed tray a stack of sheet masks that have been moistened with a chemical solution and then Z-folded is placed, wherein the Z-folded sheet masks are stacked in such a way that, when the sheet masks are stacked in a vertical direction and the sheet-mask package is placed with the hole in the holed tray facing up, an end of a bottom face of a sheet mask at a top is positioned above an end of a top face of a sheet mask underneath in a manner that each sheet mask can be pulled out through the hole from an end of a top face of each sheet mask.

2. A sheet-mask package according to claim 1, wherein the hole is made in such a way that a preformed hole is sealed with a liquid-impermeable sheet and the hole is opened when the liquid-impermeable sheet is removed.

3. A sheet-mask package according to claim 1, wherein, when the sheet-mask package is placed with the hole in the holed tray facing up, an end of a top face of a Z-folded sheet mask is positioned at a center of the Z-folded sheet mask.

4. A sheet-mask package according to claim 1, wherein the package box contacting the hole provided in the holed tray has a window formed in it that can be opened for dispensing.

5. A sheet-mask package according to claim 4, wherein the package box contacting the hole provided in the holed tray has an outline of a window pre-formed using a thin area part so that a window can be formed in such a way that the outline of the window is torn by applying an external force along the thin area.

6. A sheet-mask package according to claim 4, wherein the window has a lid member that can engage with and hermetically seal a rim of the window.

7. A sheet-mask package according to claim 1, wherein the holed tray in which the sheet masks are placed is combined with a separate tray positioned upside down.

8. A sheet-mask package constituted by a package box with a window, in which sheet masks that have been moistened with a chemical solution, Z-folded, and stacked together, are stored, wherein the Z-folded sheet masks are stacked in such a way that, when the sheet masks are stacked in a vertical direction and the sheet-mask package is placed with the hole in the holed tray facing up, an end of a bottom face of a sheet mask at a top is positioned above an end of a top face of a sheet mask underneath in a manner that each sheet mask can be pulled out through the hole from an end of a top face of each sheet mask.

9. A sheet-mask package according to claim 8, wherein an end of a top face of a Z-folded sheet mask is positioned at a center of the Z-folded sheet mask.

10. A sheet-mask package according to claim 8, wherein the package box has an outline of a window pre-formed using a thin area part so that a window can be formed in such a way that the outline of the window is torn by applying an external force along the thin area.

11. A sheet-mask package according to claim 10, wherein the window has a lid member that can engage with and hermetically seal a rim of the window.

12. A sheet-mask package according to claim 2, wherein, when the sheet-mask package is placed with the hole in the holed tray facing up, an end of a top face of a Z-folded sheet mask is positioned at a center of the Z-folded sheet mask.

13. A sheet-mask package according to claim 2, wherein the package box contacting the hole provided in the holed tray has a window formed in it that can be opened for dispensing.

14. A sheet-mask package according to claim 2, wherein the holed tray in which the sheet masks are placed is combined with a separate tray positioned upside down.

* * * * *